US006432005B1

(12) United States Patent
Lin

(10) Patent No.: US 6,432,005 B1
(45) Date of Patent: Aug. 13, 2002

(54) RACKET WITH LENGTHENED LONGITUDINAL STRINGS

(76) Inventor: Ryan Lin, No. 6-1, Lane 121, I-Chun St., Wu-Jih Hsiang, Taichung Hsien (TW)

( * ) Notice: Subject to any disclaimer, the term of this patent is extended or adjusted under 35 U.S.C. 154(b) by 0 days.

(21) Appl. No.: 09/873,182

(22) Filed: Jun. 5, 2001

(51) Int. Cl.[7] ..... A63B 49/02; A63B 49/08
(52) U.S. Cl. ..... 473/540; 473/543; 473/546
(58) Field of Search ..... 473/524, 534, 473/540, 542, 546, 543

(56) References Cited

U.S. PATENT DOCUMENTS

| | | | | | |
|---|---|---|---|---|---|
| 2,089,118 | A | * | 8/1937 | Fritsch | 473/534 |
| 4,026,553 | A | * | 5/1977 | Vendramini | 473/531 |
| 4,322,076 | A | * | 3/1982 | Bertram et al. | 473/537 |
| 4,333,650 | A | * | 6/1982 | Soong | 473/537 |
| 4,595,201 | A | * | 6/1986 | Fischer | 473/534 |
| 4,613,138 | A | * | 9/1986 | Haythornthwaite | 473/534 |
| 4,754,968 | A | * | 7/1988 | Fischer | 473/534 |
| 4,765,621 | A | * | 8/1988 | Game | 473/534 |
| 5,919,104 | A | * | 7/1999 | Mortvedt et al. | 473/538 |
| 6,027,420 | A | * | 2/2000 | Soong | 473/540 |

FOREIGN PATENT DOCUMENTS

| | | | | |
|---|---|---|---|---|
| DE | 3714571 | * | 12/1988 | 473/FOR 179 |
| EP | 211738 | * | 2/1987 | 473/FOR 179 |
| GB | 472300 | * | 9/1937 | 473/FOR 179 |
| GB | 2226250 | * | 6/1990 | 473/FOR 179 |

* cited by examiner

*Primary Examiner*—Raleigh W. Chiu
(74) *Attorney, Agent, or Firm*—Fei-Fei Chao; Venable, Baetjer, Howard & Civiletti, LLP

(57) ABSTRACT

A racket includes a frame, a Y-shaped throat integrally extending from the frame, a shaft integrally extending from the throat and a handle formed on the free end of the shaft. An end piece is attached to a free end of the handle. The end piece includes a rod integrally formed in the end piece perpendicular to a plane that contains the elements of the racket. The throat includes two hollow arms each having a slot defined to face the frame. The shaft and the handle are hollow. The longitudinal strings near the middle portion of the frame can pass through the slot into the shaft, loop around the rod and pass through the shaft and the slot to lengthen the strings. The lengthened string can absorb the reactive force and prevent the players from sustaining sport injuries.

4 Claims, 4 Drawing Sheets

RACKET WITH LENGTHENED LONGITUDINAL STRINGS

BACKGROUND OF THE INVENTION

1. Field of the Invention

The present invention relates to a racket, and more particularly to a racket that lengthens the longitudinal strings of the racket and the longitudinal strings are not parallel to one another.

2. Description of Related Art

With reference to FIG. 4, a conventional racket (90) in accordance with the prior has a frame (92) and a handle (94) integrally formed on one plane. Multiple strings (96) are interlocked within the frame (92) to form a net-like structure for striking a ball (not shown).

Sport's injuries to a player's wrist occur due to the reactive force generated when striking the ball so a shock absorbing device is mounted on an outer periphery of the frame (92) between the frame (92) and the strings. However, the manufacturing cost of such a racket is very high because it is hard to make. Some manufacturers changed the material of the strings to reduce the manufacturing cost. However, just changing the material of the string without altering the fundamental structure of the racket will provide very little absorbing effect and will not satisfy many players.

The present invention has arisen to mitigate and/or obviate the disadvantages of the conventional racket.

SUMMARY OF THE INVENTION

The main objective of the present invention is to provide an improved racket that will absorb a significant amount of the reactive force generated when the racket strikes a ball. To achieve the objective, the racket in accordance with the present invention comprises an elliptical frame, a Y-shaped throat integrally extending from the frame, a shaft integrally extending from the throat and a handle formed on the free end of the-shaft. All the elements of the racket are arranged one plane. An end piece is attached to a free end of the handle. The end piece includes a rod integrally formed in the end piece and is perpendicular to the plane in which the elements of the racket are arranged. The throat includes two hollow arms each having a slot defined to face the frame. The shaft and the handle are hollow.

By such a configuration, the longitudinal strings near the middle portion of the frame can pass through the slot into the shaft, loop around the rod and pass through the shaft and the slot to lengthen the string. The lengthened string can absorb the reactive force and prevent players from sustaining sport injuries.

Further benefits and advantages of the present invention will become apparent after a careful reading of the detailed description with appropriate reference to the accompanying drawings.

DETAILED DESCRIPTION OF THE INVENTION

Figure 1:
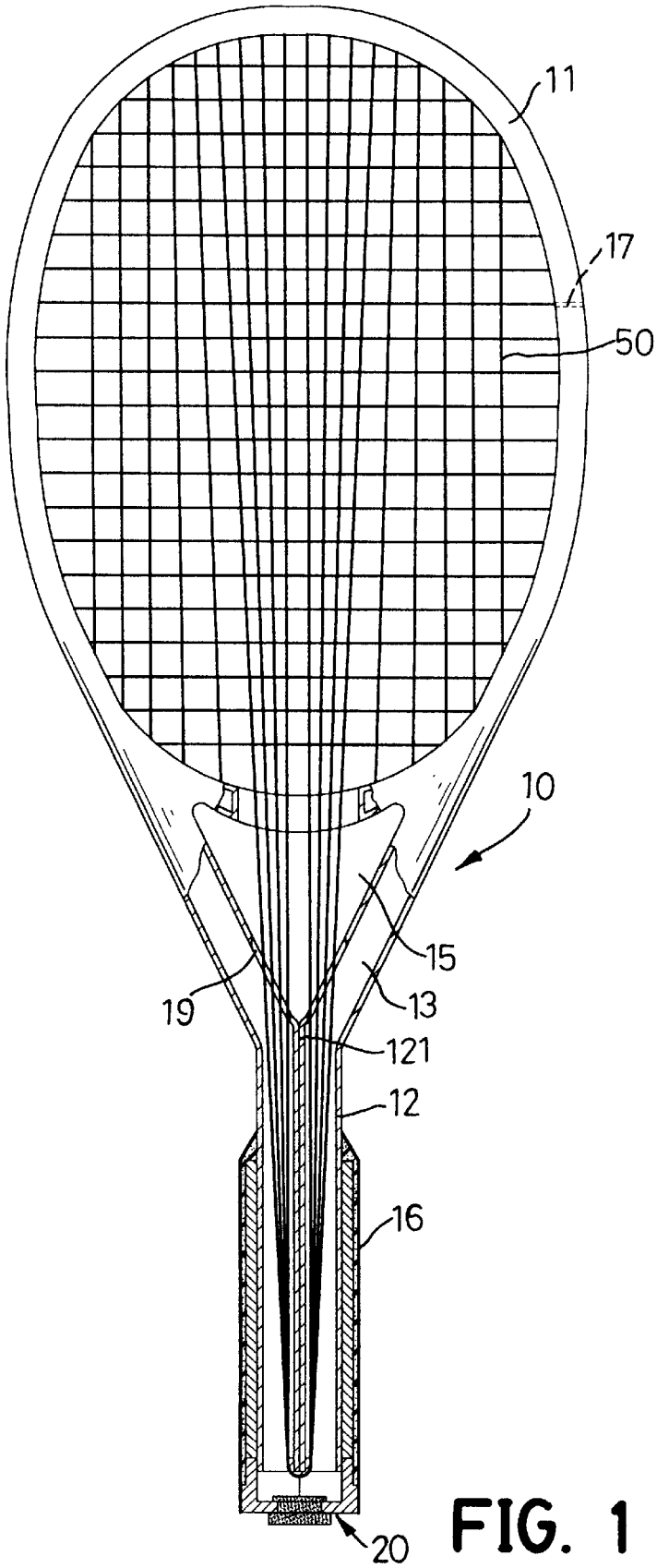
FIG. 1 is a front plan view in partial section of a racket in accordance with the present invention.

With reference to the drawings and initially to FIG. 1, a racket (10) in accordance with the present invention comprises an elliptical frame (11), a Y-shaped throat (15), a shaft (12) and a handle (16) integrally formed on one plane. Multiple through holes (17) are defined in the frame (11) to allow the strings (50) to interlock inside the confines of the frame (11) to form a net-like structure for striking a ball.

Figure 2:
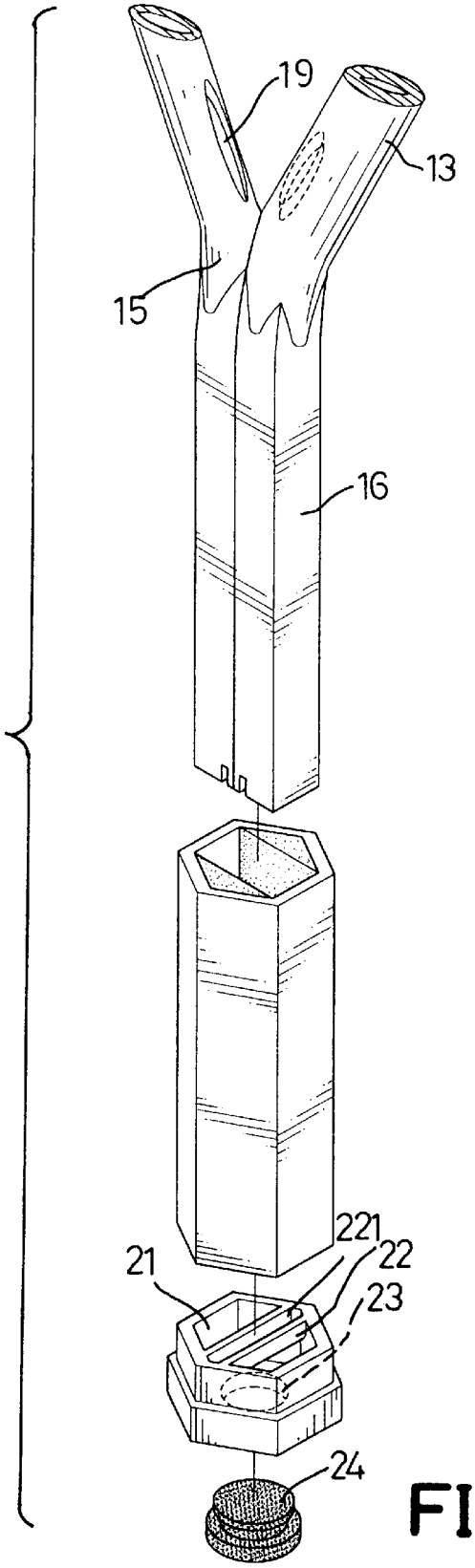
FIG. 2 is an enlarged, partially exploded perspective view in partial section of the handle and neck of the racket in FIG. 1.
Figure 3:
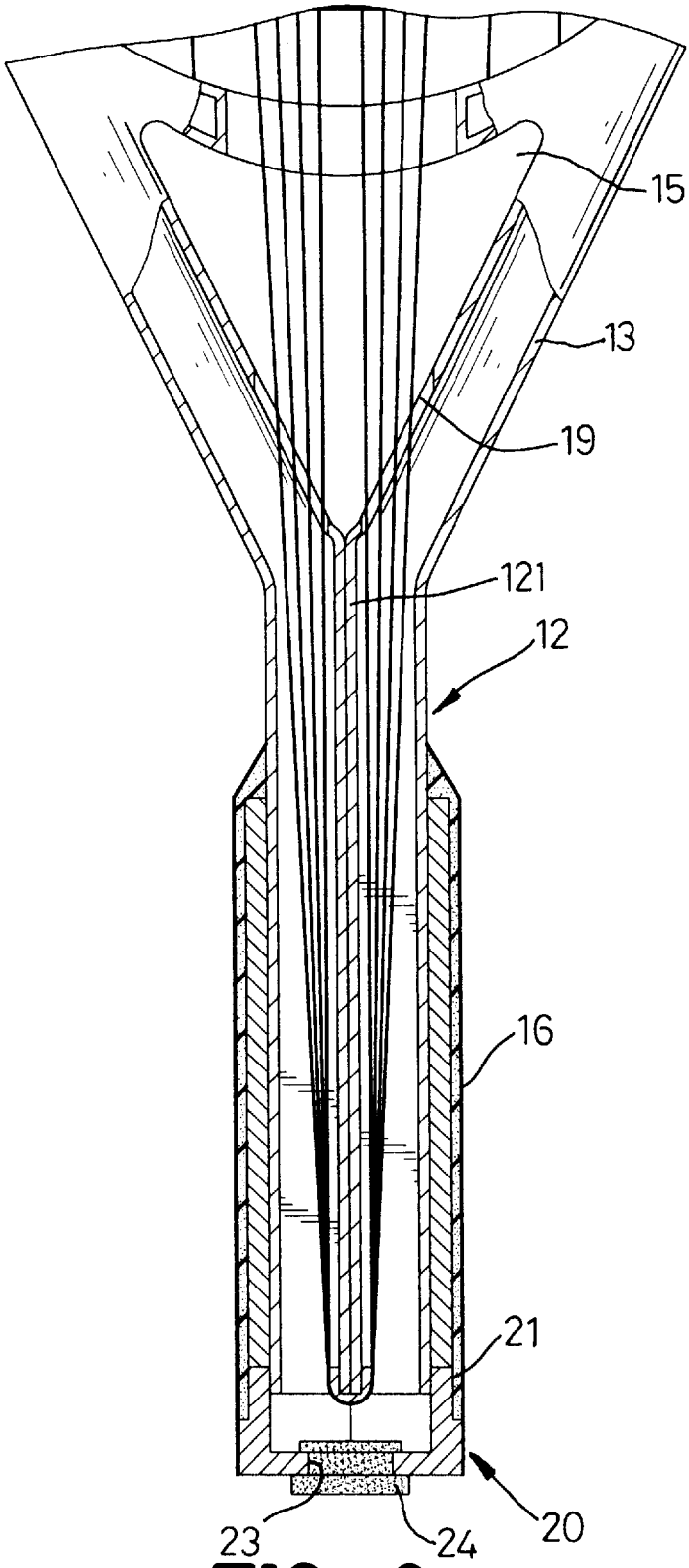
FIG. 3 is an enlarged cross sectional front plan view of the handle, throat and lower frame of the racket in FIG. 1.
Figure 4:
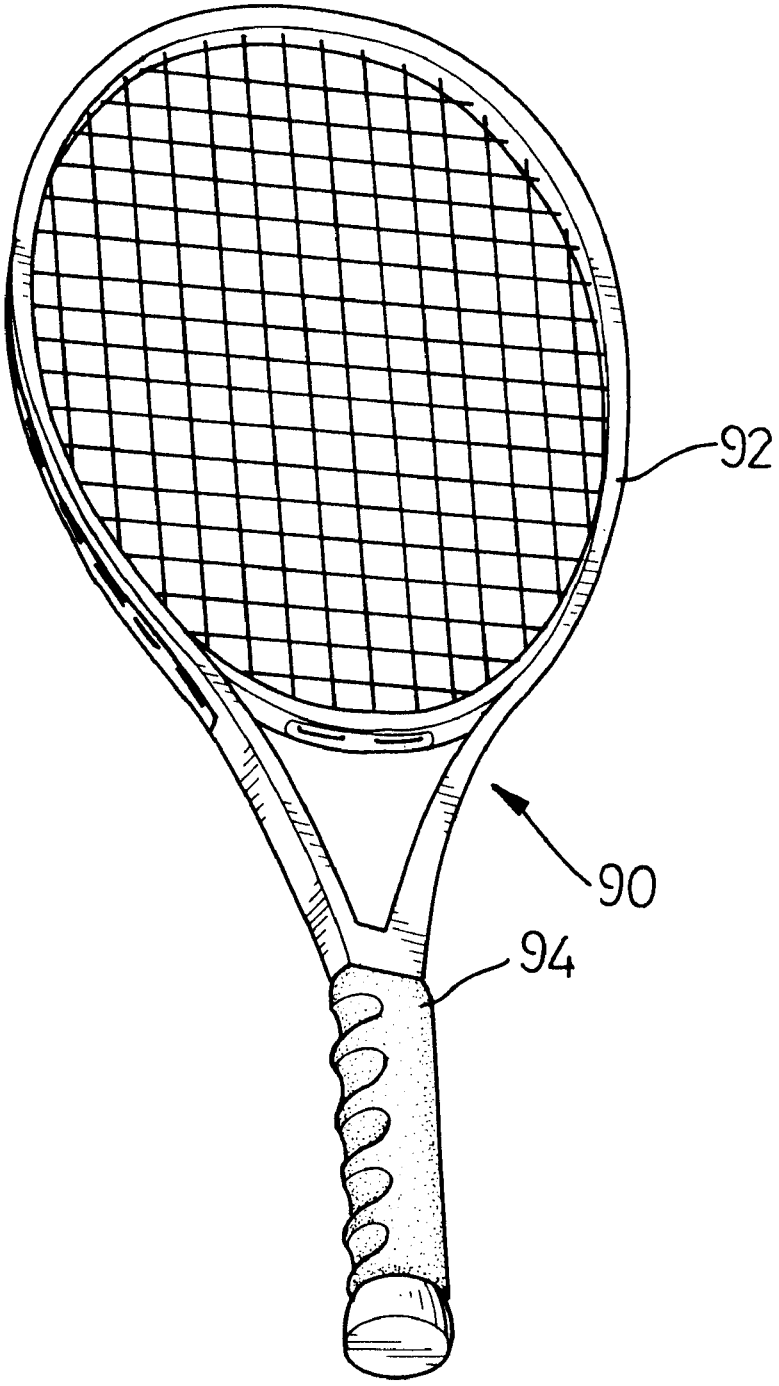
FIG. 4 PRIOR ART
FIG. 4 is a perspective view of a conventional racket on accordance with the prior art.

With reference to FIGS. 1–3, the shaft (12) and the Y-shaped throat (15) are hollow and communicate with each other. A partition (121) is longitudinally and centrally formed in the shaft (12). The throat (15) includes two hollow arms (13) respectively integrally connected to the frame (11). The two arms (13) of the throat (15) forms a V-shape, and each has a slot (19) defined to face the frame (11). The racket (10) includes an end piece (20) attached to one end of the handle (16) opposite to the frame (11). The end piece (20) includes a bottom having a through hole (23) defined in the bottom of the end piece (20). An interior skirt (21) extends toward the handle (16) from and around the bottom of the end piece (20). The skirt (21) is received in the handle (16) to hold the end piece (20) on the handle (16). A rod (22) is diametrically formed in the end piece (20) to allow strings (50) to change direction in the end piece (20). A groove (221) is defined longitudinally in the rod (11) to receive the end of the partition (121). A plug (24) is attached to the end piece (20) to close the through hole (23) in the bottom of the end piece (20).

As described above, the longitudinal strings near the middle portion of the frame can pass through the throat (15), the slot (19) into the shaft (12) and loop around the rod (22) in the end piece (20). Then the string (50) passes through the shaft (12) and the slot (19) into the frame again to lengthen the longitudinal string. The lengthened longitudinal strings can absorb the reactive force and prevent the players from sustaining sport injuries. Furthermore, the lengthened strings is looped around the rod (22) so that a pulling force is formed by the lengthened strings to pull the end piece (20) to securely abut the handle (16). Consequently, the groove (221) in the rod (22) is securely mounted on the end of the partition (121) to strengthen the structure of the racket.

Although the invention has been explained in relation to its preferred embodiment, it is to be understood that many other possible modifications and variations can be made without departing from the spirit and scope of the invention as hereinafter claimed.

What is claimed is:

1. A racket (10) comprising:

a frame (11) having multiple through holes (17) defined in a periphery of the frame (11) to allow strings (50) to interlock within the confines of the frame (11) to form a net-like structure;

a throat (15) integrally connected to the frame (11);

a hollow shaft (12) integrally extending from the throat (15) opposite to the frame (11) and forming a handle (16) on a free end of the shaft (12), wherein the shaft (12) comprises a partition (121) longitudinally formed in the shaft (12); and a hollow end piece (20) attached to the free end of the shaft (12), the hollow end piece (20) including a rod (22) diametrically formed in the end piece (20) perpendicular to the frame (11) to allow the strings (50) to loop through the end piece (20), and the rod (22) comprises a groove (221) defined longitudinally in the rod (22) to receive an end of the partition (121) in the shaft (12);

wherein the longitudinal strings near a middle portion of the frame pass through the throat (15) and into the shaft (12) and loop around the rod (22) in the end piece (20), and the strings (50) pass through the shaft (12) into the confines of the frame (11) again to lengthen the longitudinal strings (50), such that the lengthened longitudinal strings absorb the reactive force and prevent the players from sustaining sport injuries.

2. The racket as claimed in claim 1, wherein the throat is Y-shaped and includes two hollow arms (13) respectively integrally connected to two opposite sides of the frame (11), each of the hollow arms (13) having a slot (19) defined to face the frame (11).

3. The racket as claimed in claim 2, wherein the end piece (20) comprises a plug (24) attached to a bottom of the end piece (20) to close a through hole (23) in the end piece (20).

4. The racket as claimed in claim 1, wherein the end piece (20) comprises a plug (24) attached to a bottom of the end piece (20) to close a through hole (23) in the end piece (20).

* * * * *